United States Patent [19]

Cassell

[11] 4,174,981

[45] Nov. 20, 1979

[54] METHOD OF MANUFACTURING SPRINGS, INCLUDING THE PRODUCTION OF ROD THEREFOR

[75] Inventor: Ralph M. Cassell, Florissant, Mo.

[73] Assignee: Laclede Steel Company, St. Louis, Miss.

[21] Appl. No.: 875,151

[22] Filed: Feb. 6, 1978

[51] Int. Cl.[2] ..... C21D 1/80; C21D 9/52; C21D 9/56

[52] U.S. Cl. ..... 148/12 B; 148/12.4

[58] Field of Search ..... 148/12 B, 12.4

[56] References Cited

U.S. PATENT DOCUMENTS 3,589,950 6/1971 Justusson ..... 148/12 B 3,847,678 11/1974 Furr ..... 148/12 B

*Primary Examiner*—W. Stallard

*Attorney, Agent, or Firm*—Koenig, Senniger, Powers and Leavitt

[57] ABSTRACT

The method of manufacturing coiled springs from hot-rolled steel rod (as distinguished from drawn wire) wherein round steel rod is formed by hot rolling with the gauge of the rod within a tolerance of ±0.010 inch and the rod not out of round more than a maximum of 0.015 inch, oil tempering the rod as produced in the hot rolling operation, without drawing it, by passing it through an austenitizing step, an oil quenching step and a tempering step, and winding springs from the oil tempered rod.

6 Claims, 2 Drawing Figures

METHOD OF MANUFACTURING SPRINGS, INCLUDING THE PRODUCTION OF ROD THEREFOR

BACKGROUND OF THE INVENTION

This invention relates to the manufacture of springs, including the production of rod for making the springs, and more particularly to the manufacture of coiled springs, e.g., helically coiled springs or conical coiled springs, including the production of round steel rod for making the springs.

Reference is made herein to "rod" and "wire". These terms are used in the sense of their technical meaning in the metallurgical arts, namely, "rod" means rod formed by hot rolling, which may be drawn into wire, and "wire" means wire drawn from "rod".

The invention is especially concerned with the manufacture of springs which are cold wound. Where such springs of uniform pitch are required, they have heretofore generally been made from oil-tempered steel wire, which is wire formed by drawing hot rolled steel rod through a drawing die, and oil tempering the resultant wire. Oil tempering is a term of art identifying a process generally involving heating the wire to austenitizing temperatures, quenching it in oil, tempering it by reheating it, and recoiling it. Reference may be made to Chapter 5, entitled Oil Tempering, of the *Steel Wire Handbook* published in 1969 by The Wire Association, Inc. for a detailed description of the oil tempering of wire.

In the overall process such as heretofore employed, after the rod has been produced by hot rolling, it is cleaned with acid, coated with lime, pulled through a drawing die, coiled, uncoiled, then fed for oil tempering successively through a first heating means for austenitizing it, an oil bath for quenching it, and a second heating means for tempering it, then recoiled, and ultimately wound into springs. It has heretofore been regarded as essential to draw the rod into wire for forming springs because the rod has not been within the necessary limits of tolerance insofar as its gauge and roundness are concerned (it is generally "out-of-round" beyond the relatively close tolerance required for the winding of springs with uniform pitch), and also because the rod has not been sufficiently smooth.

SUMMARY OF THE INVENTION

Among the several objects of this invention may be noted the provision of a method of manufacturing coiled springs, including the production of rod particularly suitable for use in the manufacture of the springs, which eliminates a substantial number of the steps of the prior method and thereby substantially reduces the time and labor involved in producing the springs and hence reduces the cost; the provision of a method of manufacturing coiled springs which entirely eliminates the drawing of the rod, including the cleaning of the rod and the coating of the rod; and the provision of such a method which, while entirely eliminating the drawing of the rod, produces spring stock which has properties substantially similar to those of oil-tempered wire, including acceptably accurate gauge and roundness and acceptable smoothness, and which is thereby suitable for manufacture of substantially high-quality springs.

In general, the invention involves the production of rod particularly suitable for the manufacture of coiled springs comprising forming round steel rod by hot rolling with the gauge of the rod within a tolerance of ±0.010 inch and the rod not out of round more than a maximum of 0.015 inch, oil tempering the rod as produced in the hot rolling operation, without drawing the rod, by passing it through an austenitizing step, an oil-quenching step, and a tempering step, and coiling the resultant oil-tempered rod, and the winding of springs from said rod.

Other objects and features will be in part apparent and in part pointed out hereinafter.

DESCRIPTION OF THE PREFERRED EMBODIMENT

In accordance with this invention, round steel rod is formed by hot rolling with the gauge of the rod within a tolerance of ±0.010 inch and with the rod not out of round more than a maximum of 0.015 inch. The gauge of the rod may range from about 0.218 inch to about 0.625 inch. The rod may be hot rolled with a gauge of 0.25 inch, for example, from such steels as AISI 1060 steel, AISI 1566 steel, or AISI 1572 steel. In further identification thereof, these steels have the following percentages of carbon and manganese:

| AISI Steel Grade Designation | Weight Percent Carbon | Weight Percent Manganese |
|---|---|---|
| 1060 | 0.55/0.65 | 0.60/0.90 |
| 1566 | 0.60/0.71 | 0.85/1.15 |
| 1572 | 0.65/0.76 | 1.00/1.30 |

It has been found that round rod may be hot rolled from the above-specified steels with the above-specified tolerances on gauge and roundness in what is known in the steel industry as a Morgan No-Twist Stelmor mill, which is manufactured by Morgan Construction Company of Worcester, Massachusetts. In order to achieve these tolerances, which are considerably closer for hot rolled rod than heretofore sought, it is necessary to start with new rolls in the mill, maintain close inspection of the rod as produced with the rolls, and discontinue use of the rolls for the production of the close-tolerance rod when the rolls have become too worn to produce it. The rolls may then be used for the production of rod with conventional tolerances, which are substantially higher than required in the present invention. For example, standard tolerance on gauge of hot rolled rod to be drawn into wire is ±0.0156 inch (0.4 mm) and on roundness is 0.025 inch (0.6 mm), in contrast to the ±0.010 inch (0.25 mm) on gauge and 0.015 inch (0.25 mm) on roundness required in accordance with the present invention. Use of new rolls also enables the hot rolling of the rod with a smoothness of surface which is quite acceptable in comparison with that of wire.

Figure 1:
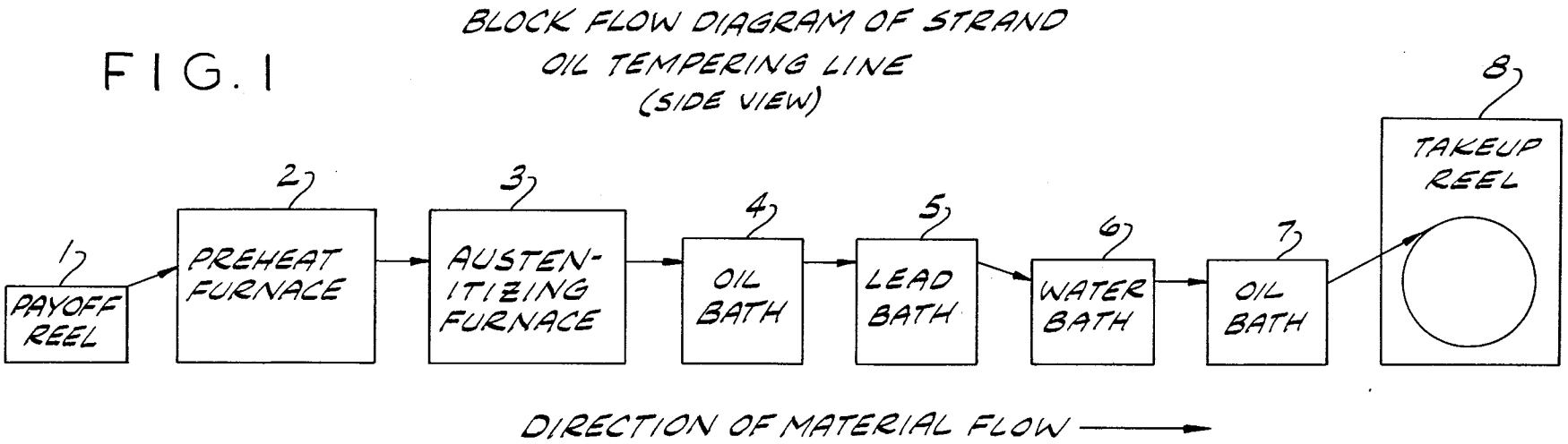
FIG. 1 is a block diagram showing the production of rod for making springs in accordance with this invention.

The hot rolled rod, with the close tolerances on gauge and roundness, and the smooth surface characteristic, produced in the No-Twist Stelmore mill by means of the use of new rolls and close inspection, is coiled in conventional manner, and subsequently oil tempered, without cleaning, coating and drawing it, by passing it through an austenitizing step, an oil-quenching step, and a tempering step, the resultant oil-tempered rod then being coiled. Referring to FIG. 1 of the drawing, the hot rolled rod R from the No-Twist Stelmor mill is shown as being uncoiled from a pay-off reel at 1, fed through a preheat furnace 2, an austenitizing furnace 3, an oil bath 4, a molten lead tempering bath 5, a water bath 6 for cooling, and an oil bath 7 for rust protection, and then coiled up on a takeup reel at 8.

For each of the above-specified steels, the preheat temperature at 2 is about 1100° F., the austenitizing temperature at 3 is about 1650° F. to 1700° F., the quenching temperature in the oil bath at 4 is about 200° F. to 225° F., and the tempering temperature in the molten lead bath at 5 is about 800° F. to 1000° F. The equipment for the oil tempering of the rod and the temperatures employed correspond generally to those conventionally used in the oil tempering of wire, except that the austenitizing temperature for the rod is higher than that conventionally used in oil tempering wire, which is 1550° F. to 1600° F.

Figure 2:
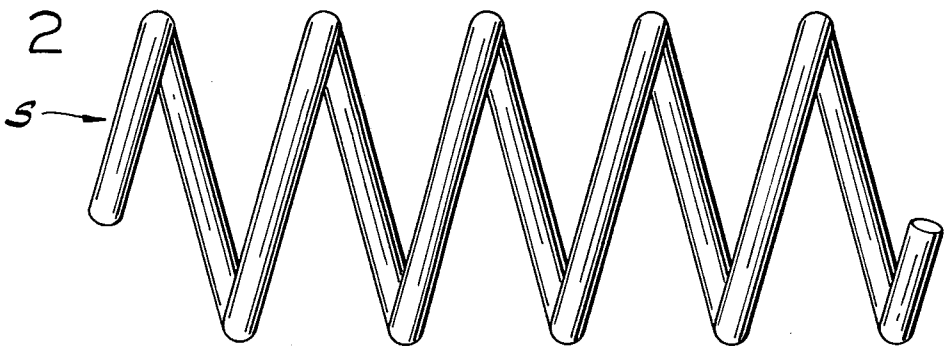
FIG. 2 is a view of a spring such as may be made from the rod.

Springs such as the helically coiled compression spring S shown in FIG. 2 are wound from the oil tempered rod produced as above described, the winding of the springs from the rod being carried out in the same manner as the prior winding of springs from oil tempered wire. It will be observed, however, that the method of the present invention eliminates the steps of cleaning the rod, coating it and drawing it, which have heretofore been regarded as necessary to obtain spring stock with the necessary tolerances on gauge and roundness and with the ncessary smoothness for substantially high quality springs. The cost of manufacture of the springs is considerably reduced due to the elimination of these three steps. At the same time, there is no chemical difference between the oil tempered rod of this invention and the more expensive oil tempered wire, and while the wire may be somewhat more accurate as to gauge, somewhat more uniformly round, somewhat smoother than the rod produced in accordance with this invention, the rod has been found to be quite satisfactory for the manufacture of springs, and more economical to produce.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. The method of producing rod particularly suitable for the manufacture of cold wound coiled springs comprising forming round steel rod by hot rolling with the gauge of the rod within a tolerance of ±0.010 inch and the rod not out of round more than 0.015 inch, oil tempering the rod as produced in the hot rolling operation, without drawing the rod, by passing it through an austenitizing step, an oil quenching step, and a tempering step, and coiling the resultant oil tempered rod.

2. The method of claim 1 wherein the rod is hot rolled from AISI 1060, 1566 or 1572 steel.

3. The method of claim 2 wherein the rod is austenitized by heating it to a temperature from about 1650° F. to 1700° F., oil quenched at a temperature from about 200° F. to 225° F., and tempered at a temperature from about 800° F. to 1000° F.

4. The method of manufacturing cold wound coiled springs comprising forming round steel rod by hot rolling with the gauge of the rod within a tolerance of ±0.010 inch and the rod not out of round more than 0.015 inch, oil tempering the rod as produced in the hot rolling operation, without drawing the rod, by passing it through an austenitizing step, an oil quenching step and a tempering step, and cold winding springs from the oil tempered rod.

5. The method of claim 4 wherein the rod is hot rolled from AISI 1060, 1566 or 1572 steel.

6. The method of claim 5 wherein the rod is austenitized by heating it to a temperature from about 1650° F. to 1700° F., oil quenched at a temperature from about 200° F. to 225° F., and tempered at a temperature from about 800° F. to 1000° F.

* * * * *